US009895707B2

(12) United States Patent
Duan et al.

(10) Patent No.: US 9,895,707 B2
(45) Date of Patent: Feb. 20, 2018

(54) METHOD AND APPARATUS FOR GENERATING MONODISPERSE AEROSOLS

(71) Applicant: MSP Corporation, Shoreview, MN (US)

(72) Inventors: Hongxu Duan, Beijing (CN); Francisco J. Romay, Vadnais Heights, MN (US); Amir A. Naqwi, Eden Prairie, MN (US); Benjamin Y. H. Liu, North Oaks, MN (US)

(73) Assignee: MSP CORPORATION, Shoreview, MN (US)

( * ) Notice: Subject to any disclaimer, the term of this patent is extended or adjusted under 35 U.S.C. 154(b) by 0 days.

(21) Appl. No.: 14/699,451

(22) Filed: Apr. 29, 2015

(65) Prior Publication Data

US 2015/0314317 A1 Nov. 5, 2015

Related U.S. Application Data

(60) Provisional application No. 61/988,593, filed on May 5, 2014.

(51) Int. Cl.

| | |
|---|---|
| ***B05B 7/00*** | (2006.01) |
| ***B05B 7/06*** | (2006.01) |
| ***B05B 17/06*** | (2006.01) |
| ***B05B 5/03*** | (2006.01) |
| *B05B 17/00* | (2006.01) |

(52) U.S. Cl.

CPC ..... *B05B 7/066* (2013.01); *B05B 5/03* (2013.01); *B05B 7/0012* (2013.01); *B05B 7/0075* (2013.01); *B05B 17/06* (2013.01); *B05B 17/0615* (2013.01); *B05B 17/0646* (2013.01)

(58) Field of Classification Search

CPC ... B05B 7/066; B05B 7/0075; B05B 17/0646; B05B 17/06; B05B 17/0615; B05B 17/0607; B08B 3/08; B01F 3/04978; B01F 11/0258

USPC ..... 239/4, 699, 102.1, 102.2; 261/81, 261/DIG. 48

See application file for complete search history.

(56) References Cited

U.S. PATENT DOCUMENTS

| | | | | |
|---|---|---|---|---|
| 3,790,079 A | | 2/1974 | Berglund et al. | |
| 4,871,489 A | * | 10/1989 | Ketcham | B01J 2/18 264/13 |
| 5,173,274 A | * | 12/1992 | Owen | B01J 19/10 239/102.2 |
| 7,518,108 B2 | * | 4/2009 | Frey | H01J 49/0045 250/281 |
| 8,272,576 B2 | | 9/2012 | Doak et al. | |

* cited by examiner

*Primary Examiner* — Viet Le

(74) *Attorney, Agent, or Firm* — Westman, Champlin & Koehler, P.A.; Z. Peter Sawicki; Amanda M. Prose

(57) ABSTRACT

A method and apparatus for generating aerosol particles that are substantially uniform in size said apparatus includes a droplet generator comprised of a metal capillary for a liquid to flow through to form a liquid stream flowing into a gas stream. The metal capillary is vibrated by a piezoelectric ceramic at a substantially constant frequency to cause the liquid stream to breakup into droplets that are substantially uniform in size in the gas stream, the gas stream being maintained at a velocity in the range between approximately 10% to 100% of the speed of sound.

15 Claims, 2 Drawing Sheets

METHOD AND APPARATUS FOR GENERATING MONODISPERSE AEROSOLS

FIELD OF THE INVENTION

This invention relates to a method and an apparatus for generating monodisperse aerosols for laboratory research and experimentation.

BACKGROUND OF THE INVENTION

The field of aerosol science and technology is concerned with the study of small particles suspended in a gas. The gas is usually air. However, particles suspended in other gaseous media, such as helium, argon, hydrogen, etc. are also considered as an aerosol.

The study of properties and behavior of small airborne particles is facilitated by the use of monodisperse aerosols, i.e. aerosol comprised of particles that are substantially uniform in size. This invention relates to a method and apparatus for generating monodisperse aerosols which may be subsequently processed to carry a specific charge or charge distribution for laboratory research and experimentation.

Many methods and apparatus have been developed by scientists and engineers working in the field of aerosol science and related fields for generating monodisperse aerosols. Examples include those described in U.S. Pat. Nos. 3,790,079 and 8,272,576 B2.

SUMMARY OF THE INVENTION

An aspect of the present disclosure relates to an apparatus for generating aerosol particles that are substantially uniform in size. The apparatus includes a droplet generator comprised of a metal capillary for a liquid to flow through to form a liquid stream. The liquid stream flows through the capillary and joins with a gas stream. The metal capillary is vibrated by a piezoelectric ceramic at a substantially constant frequency causing the liquid stream to breakup into droplets of a substantially uniform size in the gas stream, with the gas stream being maintained at a velocity in the range between approximately 10% to 100% of the speed of sound.

Another aspect of the present disclosure relates to a method for generating monodisperse aerosol particles, which includes flowing a liquid at a selected liquid flow rate through a vibrating metal capillary, the metal capillary being vibrated by a piezoelectric ceramic at a substantially constant frequency. Flowing a gas stream proximate an exit of the metal capillary such that gas stream joins the liquid exiting the metal capillary allows droplets to form of a substantially uniform size. The method further comprises adjusting said liquid flow rate to a selected set-point value and adjusting the gas flow rate to a range between approximately 10% to 100% of the speed of sound.

Yet another aspect of the present disclosure relates to a method for generating monodisperse aerosol particles by combining a liquid stream exiting a vibrating capillary with a gas stream flowing at a velocity in a range between approximately 10% to 100% of the speed of sound to generate droplets in the gas stream. The vibrations are produced by a piezoelectric source and the droplets produced are substantially uniform size.

DETAILED DESCRIPTION OF THE INVENTION

Figure 1:
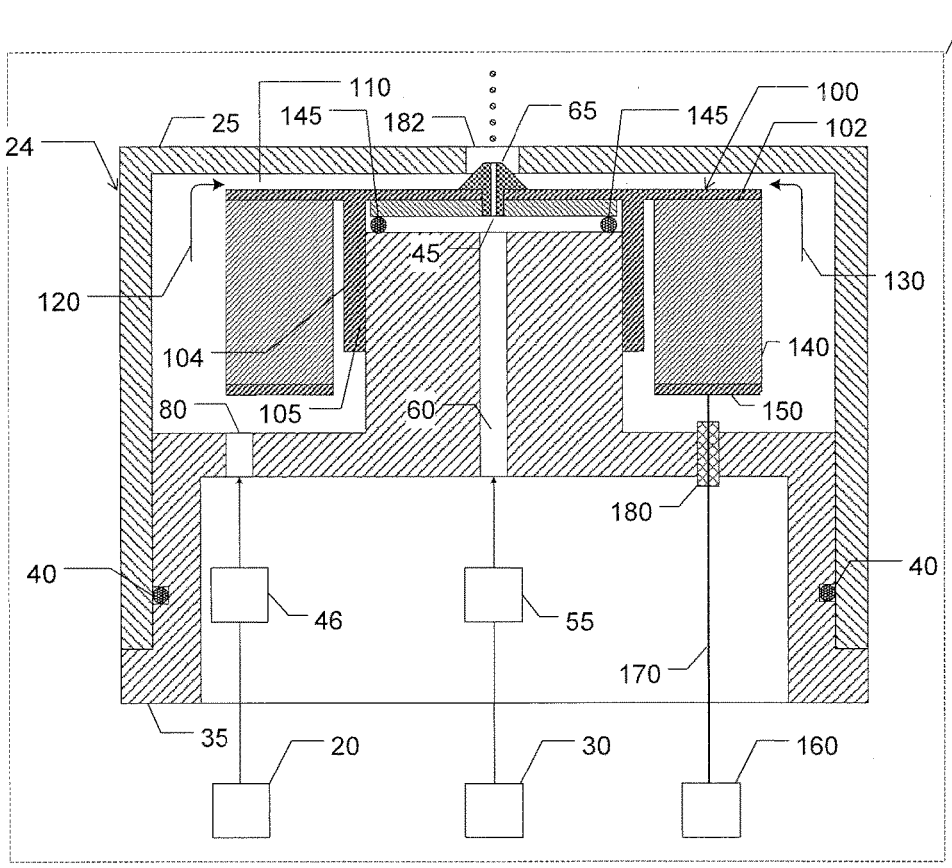
FIG. 1 is a schematic diagram of the system for generating monodisperse aerosols described in the present disclosure

FIG. 1 is a schematic vertical sectional view of the apparatus (also referred to as a system) for generating monodisperse droplets described in the present disclosure. The apparatus may have a cylindrical cross section and is generally illustrated at 10. The apparatus 10 includes a housing 24 comprising a metal cover cap piece 25 and a metal base piece 35, the pieces being sealed at a connection point with an O-ring 40 between the two pieces. The apparatus 10 is provided with a source of compressed gas 20 and a source of liquid 30. The liquid from source 30 flows into droplet generating head 65 through liquid flow controller 55, at a specific selected set-point value. The liquid then flows into flow channel 60 and into capillary flow channel 45 in the droplet generating head 65. At substantially the same time, compressed gas from source 20 flows through gas flow controller 46 at a specific selected set point value through a hole, preferably a cylindrical hole 80 and into the gap space 110 between the metal cap piece 25 and an internal metal support 100 as shown by arrows 120 and 130. The metal support 100 comprises a top annular section 102 and a cylindrical lower section 104. All metal pieces, including the cap 25, the metal support 100 and base 35, are typically made of a metal such as stainless steel. The metal base 35, is provided with an O-ring seal 145 to prevent liquid from source 30 from leaking out of liquid flow channel 60.

Attached to metal support 100 is a cylindrical shaped-piezoelectric ceramic 140. The piezoelectric ceramic 140 is attached to a bottom surface of the section 102 at a top end and to a bottom metal electrode 150 at a bottom surface, the top and bottom surfaces of the piezoelectric ceramic being attached to the section 102 and metal electrode 150 respectively by a suitable adhesive cement. An AC voltage, from voltage source 160 is provided by a metal wire 170 through insulator 180 to the bottom electrode 150 to cause the piezoelectric ceramic 140 to vibrate at substantially the same frequency as the AC voltage from the voltage source 160. Since the AC voltage is at a substantially constant frequency the vibrations in the piezoelectric ceramic occur at a substantially constant frequency which causes droplets forming to be of a substantially uniform size. The metal support 100 is threaded and is screwed onto the base with threads 105. The vibrations from the piezoelectric source ceramic 140 are transmitted at a substantially constant frequency through the support 100 to the droplet generating head 65 and to the liquid stream flowing out of the droplet generating head 65, which forms a stream of uniformly sized monodisperse droplets flowing out of the droplet generating head 65.

The use of a piezoelectric ceramic material to create mechanical vibration for the controlled disintegration of a liquid jet to form uniform droplets is well known. Such an approach is described in U.S. Pat. Nos. 3,790,079 and 8,272,576 B2, which are hereby incorporated by reference and will not be further explained.

The gas identified by arrows 120 and 130 flows through and out of cap 25 through outlet 182 which at least partially surrounds the droplet generating head 65 as the droplet generating head 65 extends upwardly and at least partially into the outlet opening 182 as illustrated in FIG. 1. When the gas flowing out of the outlet 182 is at a velocity that is lower than approximately 10% of the speed of sound in the gas, the liquid flowing out of the capillary flow passage way 45 will form a jet with a diameter that is of the same order of magnitude as the diameter of the capillary as the gas flow and the liquid flow are directed out of the outlet 182 and droplet generating head 65 in parallel directions. This means that a large diameter capillary passage way 45, will result in formation of large diameter droplets of the same order of magnitude. Using a capillary diameter of for example, approximately 100 μm, the droplet diameter will typically be on the order of approximately 200 μm.

The apparatus and method of the present disclosure achieve a liquid-jet and droplet diameter as small as possible. This is accomplished using the flow focusing effect by increasing the gas flow velocity in the gas flow passageway in the outlet 182 in the cap 25.

Flow focusing refers to the effect of a high gas flow velocity surrounding a liquid jet traveling at a slower velocity to cause the liquid jet diameter to become narrower and thus more sharply focused. The maximum gas velocity achievable in the gas outlet 182 is the speed of sound. Thus, the maximum flow focusing effect is achieved when the gas flow becomes sonic. For air, which is comprised mainly of diatomic gas molecules of oxygen and nitrogen, the speed of sound at normal atmospheric temperature of approximately 23° C. and a pressure of approximately one atmosphere is approximately 343 meters per second. For the purpose of creating flow focusing in this disclosure, the mean velocity gas flowing out of the outlet 182, which is a narrow gap space, can be set in the range between approximately 10% and 100% of the speed of sound. Therefore the nominal gas velocity used for flow focusing is usually between the limit of approximately 34.3 meters per second and approximately 343 meters per second. Generally, the smaller the droplet diameter desired, the higher is the gas flow velocity needed to achieve the smaller diameter. To achieve a droplet diameter of approximately 0.1 μm, the gas flow velocity generally will need to be set to close to the speed of sound in the gas.

For generating monodisperse aerosol particles comprised of small, stable, non-volatile material suspended in air or other gases for laboratory experimentation, a non-volatile material can be dissolved in a volatile solvent to form a solution. The solution droplets created by the droplet generation apparatus described in this disclosure can then be allowed to evaporate to form non-volatile monodisperse particles of a much smaller diameter.

For example, in order to generate a monodisperse sodium chloride (NaCl) aerosol, an aqueous solution of NaCl can be prepared by dissolving the non-volatile NaCl solid in water. When the water evaporates from the NaCl solution droplets, monodisperse NaCl particles are formed as residue particles of the solution droplets. Using this approach, it is possible to generate monodisperse NaCl particles as small as approximately 20 nm, i.e. 0.02 μm, if the solution droplet diameter is approximately 1 μm. Other aerosol materials of interest can similarly be generated by the solvent evaporation technique.

Figure 2:
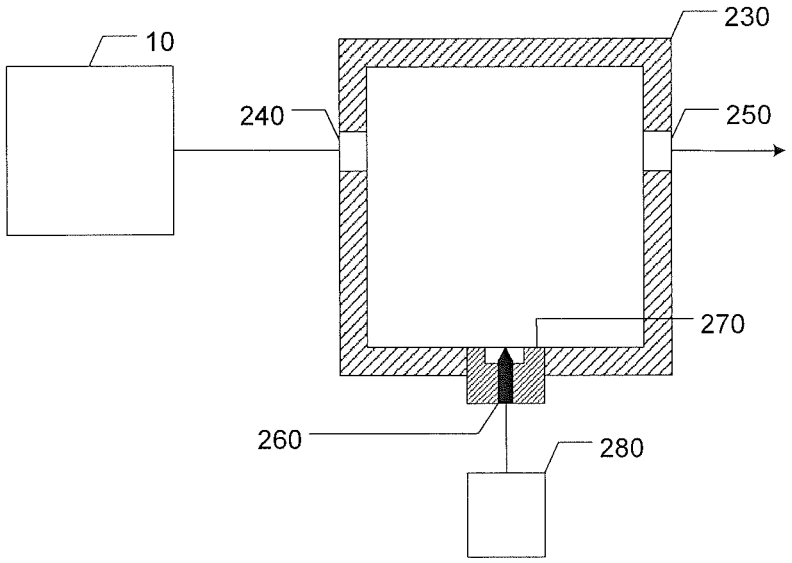
FIG. 2 is a schematic diagram of the aerosol charging apparatus described in the present disclosure

FIG. 2 is a schematic diagram of a charging apparatus for placing an electrical charge on the monodisperse aerosol generated by the methods described herein. The droplet generator 10 is used as an aerosol generator to create a monodisperse aerosol in the submicron size range, typically in the range between approximately 20 nm, i.e. 0.02 μm, to approximately 1 μm in diameter. The aerosol then flows into aerosol charging apparatus 230, which is approximately cubical in shape with an inlet 240 and outlet 250 for the aerosol to enter and exit respectively. Both inlet 240 and outlet 250 are in the form of circular holes machined or drilled into the cubical-shaped charging apparatus. The charging apparatus is typically made of a metal, for example, aluminum.

The charging apparatus 230 includes a metal needle 260 with a sharp tip. Needle 260 is held on a support, 270, which is made of an insulating material. Needle 260 is connected to a high-voltage power supply 280 in order to generate gaseous ions in the gaseous medium of the aerosol.

In some applications, unipolar corona ions of either a positive or a negative polarity are desired. In the embodiment illustrated in FIG. 2, a DC high-voltage power supply 280 capable of generating the specific polarity of the DC voltage will be needed. In some embodiments, it is desired to generate corona ions of both a positive and negative polarity in the gaseous medium. In these embodiments, an AC power supply can be used. Typically the voltage needed to generate a self-sustaining corona discharge is on the order of a few thousand volts. The art of designing corona discharge systems for generating corona ions is well known to those skilled in the art of designing corona generation apparatus, and will not be further discussed.

When using a DC high-voltage power supply to generate unipolar ions of either a positive or a negative polarity, corona ions of either positive or negative polarity will collide with the aerosol particles to transfer a charge to the particles. The resulting charge on the particles will also be unipolar, i.e. all having the same polarity. For a small particle size, only a fraction of the particles will be charged. The fraction of particles carrying a charge is a complex function of the particle size, the concentration of corona ions in the gas phase, and the total residence time of the aerosol in the charging apparatus.

When an AC voltage is used to generate corona ions in the aerosol charging apparatus, particles of both polarities will appear in the aerosol. In these cases, approximately equal concentration of positively and negatively charges particles will appear in the aerosol. The overall charge on the aerosol cloud will be substantially equal to zero.

When making measurement in aerosols with a small particle size, using a unipolar charge will generally lead to greater sensitivity of measurement. As a result using a DC power supply to generate unipolar ions will generally give rise to greater measurement sensitivity and may be preferred in some aerosol measurement applications.

Although the present disclosure has been described with reference to preferred embodiments, workers skilled in the art will recognize that changes may be made in form and detail without departing from the spirit and scope of the invention.

What is claimed is:

1. An apparatus for generating aerosol particles that are substantially uniform in size, the apparatus comprising:

a housing comprising a cap and a base sealed at a connection point;

a droplet generator comprising a metal capillary having an exit orifice for a liquid to flow through to form a liquid stream having a first velocity in a liquid flow direction through the exit orifice;

a mechanism for generating a gas stream having a second velocity in a gas flow direction, wherein the gas stream flows out of an outlet in the cap and wherein the outlet is positioned to at least partially surround the exit orifice of the metal capillary as the exit orifice extends at least partially into the outlet in the cap, such that the liquid stream flows into said gas stream as the liquid flow direction and gas flow direction are substantially the same, such that the gas stream surrounds the liquid stream to form a focused liquid jet stream surrounded by a gas sheath;

a piezoelectric ceramic configured to vibrate the metal capillary, the piezoelectric ceramic being vibrated at a substantially constant frequency to cause said focused liquid jet stream surrounded by the gas sheath to breakup into a focused stream of droplets surrounded by the gas sheath that are substantially uniform in size, said gas stream being maintained at the second velocity in the range between approximately 10% to 100% of the speed of sound, wherein the second velocity is greater than the first velocity.

2. The apparatus of claim 1 wherein said gas comprises air and said speed of sound in said gas is approximately 343 meters per second at a pressure of approximately 1 atmosphere and temperature of approximately 23 degrees C.

3. The apparatus of claim 1 further comprising an aerosol particle charging apparatus comprising:

a metal chamber with an inlet and an outlet for said aerosol particles to flow through;

a high-voltage power supply; and a needle electrode to form unipolar or bipolar ions in said metal chamber and cause said aerosol particles flowing through said metal chamber to become charged and emerge from the metal chamber with either a unipolar or a bipolar charge.

4. A method for generating monodisperse aerosol particles, the method comprising providing a housing comprising a cap and a base, the cap and the base sealed at a connection point;

flowing a liquid at a selected liquid flow rate and in a first flow direction from a liquid source and through a metal capillary and vibrating the metal capillary with a piezoelectric ceramic at a substantially constant frequency;

flowing a gas stream at a selected gas flow rate from a gas source to an outlet in the cap, wherein the gas flow is greater than the selected liquid flow rate and in a second flow direction that is substantially the same as the first flow direction, the gas flowing through the outlet that at least partially surrounds an exit orifice of the metal capillary as the exit orifice at least partially extends into the outlet such that the gas stream joins and surrounds the liquid exiting the metal capillary, forming a focused liquid flow surrounded by a gas sheath and causing droplets to form of a substantially uniform size;

adjusting said liquid flow rate to a selected set-point value less than the gas flow rate; and adjusting the gas flow rate to a range between approximately 10% to 100% of the speed of sound.

5. The method of claim 4 and further comprising the additional step of introducing said monodisperse aerosol particles into a particle charging apparatus having an ionizing chamber to cause said monodisperse aerosol particles to become charged and carry a unipolar or a bipolar charge.

6. The method of claim 4, wherein the piezoelectric ceramic is vibrated by applying a selected voltage to the piezoelectric ceramic.

7. The method of claim 6, wherein the size of the monodisperse aerosol particles may be changed by adjusting the frequency of the voltage being applied.

8. The method of claim 4, wherein the size of the monodisperse aerosol particles may be changed by adjusting the velocity of the gas stream.

9. The method of claim 4, wherein the size of the monodisperse aerosol particles may be changed by adjusting the diameter of the capillary.

10. A method for generating monodisperse aerosol particles, the method comprising: combining a liquid stream exiting a vibrating capillary through an exit orifice in a cap in a first flow direction with a gas stream flowing through an outlet in the cap.

11. The method of claim 10, wherein the piezoelectric source is piezoelectric ceramic vibrated by applying a selected voltage to the piezoelectric ceramic.

12. The method of claim 11, and further comprising adjusting the frequency of the voltage being applied to the piezoelectric ceramic to change the size of the monodisperse aerosol particles.

13. The method of claim 10, and further comprising adjusting the velocity of the gas stream to change the size of the monodisperse aerosol particles.

14. The method of claim 10, and further comprising adjusting the diameter of the capillary to change the size of the monodisperse aerosol particles.

15. The method of claim 10, and further comprising introducing said monodisperse aerosol particles into an ionizing chamber to cause said monodisperse aerosol particles to become charged and carry a unipolar or a bipolar charge.

* * * * *